United States Patent [19]

Marx

[11] 4,281,437

[45] Aug. 4, 1981

[54] METHOD AND APPARATUS FOR OPENING TEXTILE FIBER BALES

[75] Inventor: Hans-Jürgen Marx, Mönchen-Gladbach, Fed. Rep. of Germany

[73] Assignee: Trützschler GmbH & Co. KG, Mönchen-Gladbach, Fed. Rep. of Germany

[21] Appl. No.: 85,476

[22] Filed: Oct. 17, 1979

[30] Foreign Application Priority Data

Nov. 2, 1978 [DE] Fed. Rep. of Germany ..... 2847460

[51] Int. Cl.[3] ..... D01G 7/06

[52] U.S. Cl. ..... 19/80 R; 19/145.5; 241/101 A

[58] Field of Search ..... 19/80 R, 80 A, 81, 145.5; 241/101 A

[56] References Cited

U.S. PATENT DOCUMENTS

| | | | |
|---|---|---|---|
| 3,101,513 | 8/1963 | Wildholz | 19/80 R |
| 3,170,196 | 2/1965 | Denis | 19/80 R |
| 3,458,904 | 8/1969 | Kotter et al. | 19/80 R |
| 3,663,993 | 5/1972 | Roberson | 19/80 R |
| 3,736,624 | 6/1973 | Alt et al. | 19/80 R |
| 3,846,870 | 11/1974 | Araki et al. | 19/80 R |

FOREIGN PATENT DOCUMENTS

| | | | |
|---|---|---|---|
| 1528453 | 4/1968 | France | 19/80 R |
| 4316911 | 7/1968 | Japan | 19/80 R |
| 437242 | 10/1935 | United Kingdom | 241/101 A |

*Primary Examiner*—Louis Rimrodt
*Attorney, Agent, or Firm*—Spencer & Kaye

[57] ABSTRACT

An apparatus for opening fiber bales has a traveling opening member propelled along serially positioned fiber bales to execute opening passes, a grate having parallel-spaced grate bars extending, in their operative position, in the traveling direction and pressing down on an upper surface of the bales. The opening member has opening elements projecting through the clearance defined by adjoining grate bars. During the opening process the relative position between the upper surface of the bales and the grate is periodically varied for periodically exposing ridges of bale material formed underneath the grate bars.

4 Claims, 8 Drawing Figures

METHOD AND APPARATUS FOR OPENING TEXTILE FIBER BALES

BACKGROUND OF THE INVENTION

This invention relates to a method for opening textile fiber bales, particularly tightly pressed cotton bales, wherein the fibers are removed from the top side of the bales by opening devices such as spiked rollers or toothed discs. The opening elements, such as spikes or teeth project through a grate and bite into the bale. The grate comprises a plurality of parallel-spaced grate bars extending in the direction in which the opening device travels. The invention further relates to an apparatus for performing the method according to the invention.

In known bale opening arrangements of the above-outlined type the opening elements, as the opening device travels along the bales, leave furrows in the top face of the fiber bales, while in the zones of compression between the grate elements and the fiber bale unremoved material remains, constituting ridges between the furrows. Such ridges can be ablated only with difficulty, because the opening elements cannot, by direct contact, reach the ridges formed of the compressed material; rather, the material forming the ridges is torn out by being entrained by the fiber material engaged directly by the opening elements. Such ridges can be removed only with difficulty and very gradually only in several passes. This circumstance adversely affects the efficiency of the apparatus in a significant degree.

SUMMARY OF THE INVENTION

It is an object of the invention to provide an improved method and apparatus of the above-outlined type from which the above-discussed disadvantage is eliminated.

This object and others to become apparent as the specification progresses, are accomplished by the invention, according to which, briefly stated, the relative position between the bale and the grate bars pressing down on the bale is periodically changed.

The invention is based on the principle to expose the ridge portions between the bars of the grate and the top face of the fiber bale in such a manner that they can be ablated with ease during a successive pass of the opening device.

According to a preferred embodiment of the invention, the grate is, subsequent to one pass (for example, a forward pass) of the opening device, displaced horizontally in a lateral direction by one half of the distance between the two adjoining grate bars. During the successive pass, for example during the return pass of the opening device, the opening elements directly engage those locations at which the ridges have been formed during the preceding, forward pass. In this manner the opening device engages successively the fiber bales alternately at laterally shifted locations.

The process according to the invention may also be implemented by providing that during one pass (for example, the forward pass) a first group of the grate bars engage the fiber bales, while a second group of the grate bars are in an upwardly pivoted, inoperative position. In this manner, ridges in the material will be built up only at the locations of pressure exerted by the grate bar group which engages the bale. For the return pass of the opening device, the first grate bar group is pivoted into an inoperative position, whereas the second grate bar group is caused to engage the bales. In this manner during the return pass those ridges which have been built up during the forward pass are exposed and can be opened with ease by means of the opening device.

In a preferred embodiment of the invention, the grate is laterally shifted subsequent to each pass of the opening device. It is also feasible to provide that a working (opening) pass occurs only in one direction, that is, no opening operation takes place during a return pass. It may be further expedient to shift the grate during the opening process, that is, during the period that the pass occurs.

The apparatus for performing the above-outlined method includes movably positioned grate bars. Expediently, the grate bars are laterally displaceably supported. It may further be advantageous to arrange the grate bars rotatably or pivotally so that they can be lifted off from the upper bale face generally in a vertical direction. In accordance with another preferred embodiment of the invention, the grate bars and the opening elements are together supported to be horizontally shiftable and thus can be shifted together as a unit. With such an arrangement the opening device may be moved in the working direction along a wavy path.

DESCRIPTION OF THE PREFERRED EMBODIMENTS

Figure 1A:
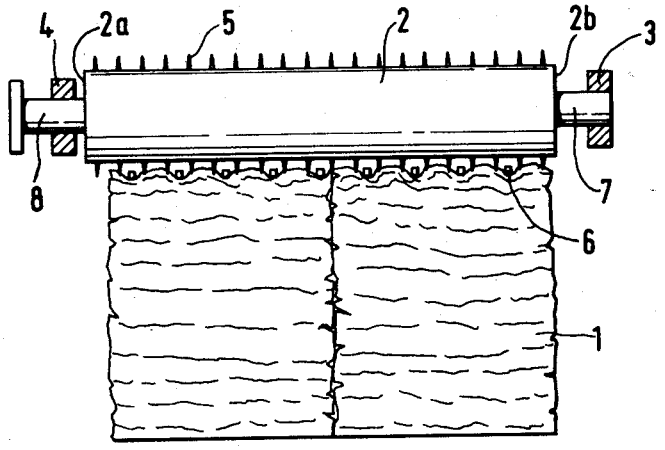
FIGS. 1*a* and 1*b* are schematic front elevational views of a preferred embodiment of the invention, shown in different operational phases.
Figure 1B:
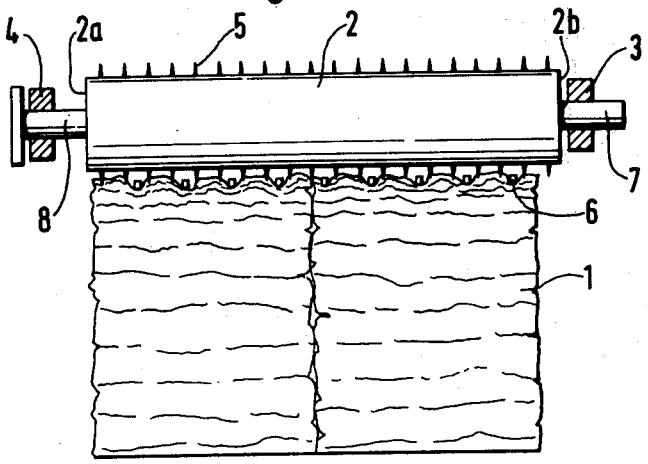

Turning now to the embodiment illustrated in FIGS. 1*a* and 1*b* there are shown fiber bales 1 positioned in pairs in a series (extending in a direction perpendicular to the drawing sheet). Above the fiber bales there is arranged an opening device constituted by an opening roller 2 which has spikes 5 and which is rotatably supported in bearings 3 and 4. On the support structure (not shown) of the opening roller 2 there is mounted a grate formed of a plurality of parallel-spaced grate bars 6 extending in the length dimension of the apparatus (that is, perpendicularly to the drawing sheet). The spikes 5 of the roller 2 reach through the spaces between adjoining grate bars 6 and "bite" into the upper material layer of the fiber bales. The grate bars lie on the upper surface of the fiber bales 1. The opening roller 2 is, by means of bearing pins 7 and 8 horizontally laterally displaceably supported in the bearings 3 and 4.

FIG. 1 depicts the operational phase in which the spiked roller 2 is performing its forward pass. As seen, the roller 2 is, with its end face 2*a*, situated immediately adjacent the bearing 4, while a play is present between the end face 2*b* and the bearing 3. After the opening device has moved, in the length dimension of the apparatus, over all the fiber bales 1, the opening roller 2 and the grate bars 6 are shifted horizontally laterally and are adjusted in a vertical direction, whereupon a pass in the opposite direction is performed. FIG. 1*b* illustrates the opening roller 2 in its position it assumes during the return pass. As seen, the opening roller 2—together with the grate bars—is laterally and horizontally shifted such that now the end face 2*b* is immediately adjoining the bearing 3, whereas between the end face 2*a* and the bearing 4 a clearance is provided. The magnitude of the lateral shift is one half the distance between two adjoining grate bars 6. In this manner the spikes 5 now work directly on the fiber bale material at locations in which, during the forward pass, a contact was maintained between the grate bars 6 and the upper surface of the fiber bales 1. Thus, the ridges formed during the forward pass are now, during the return pass, ablated with ease due to the lateral shift of the grate.

Figure 2A:
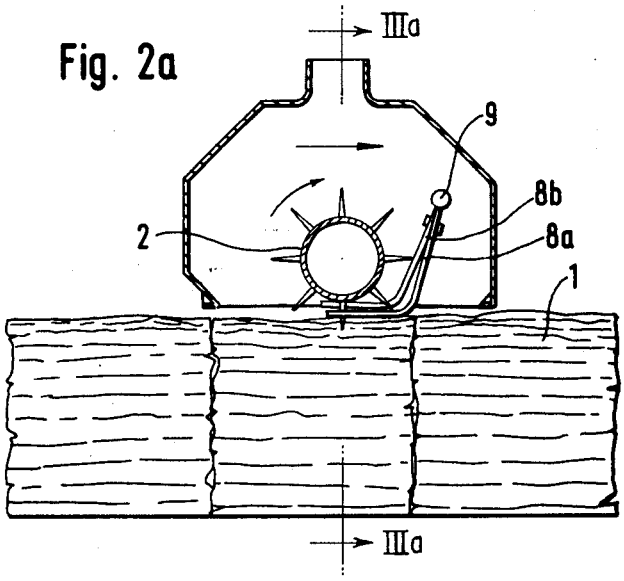
FIGS. 2*a* and 2*b* are schematic side elevational views of another preferred embodiment of the invention, shown in different operational phases.
Figure 2B:
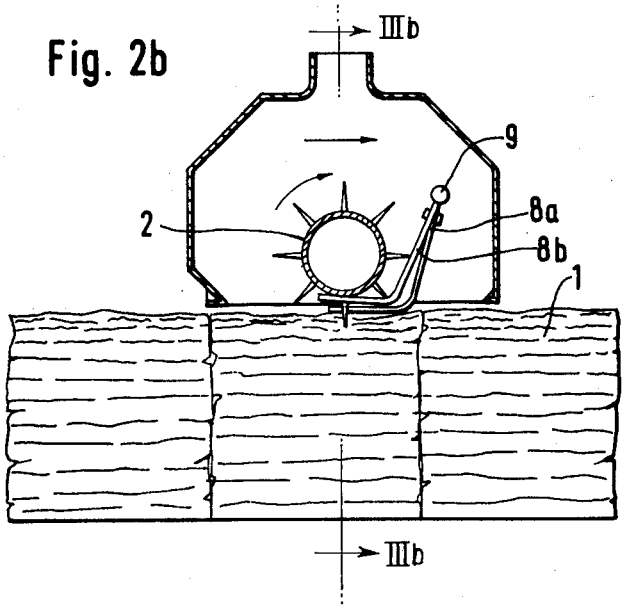
Figure 3A:
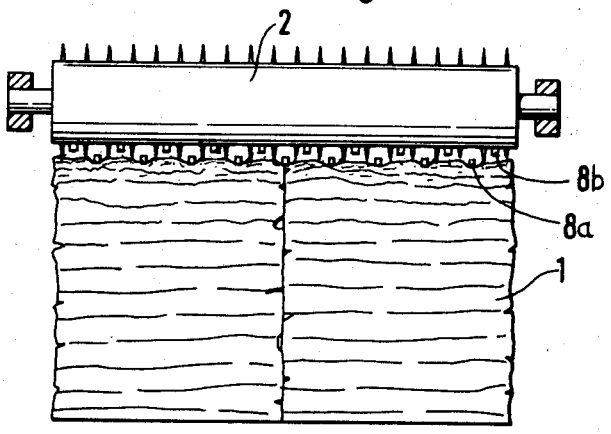
FIGS. 3*a* and 3*b* are partial schematic sectional front elevational views taken along lines IIIa—IIIa of FIG. 2*a* and lines IIIb—IIIb of FIG. 2*b*, respectively.
Figure 3B:
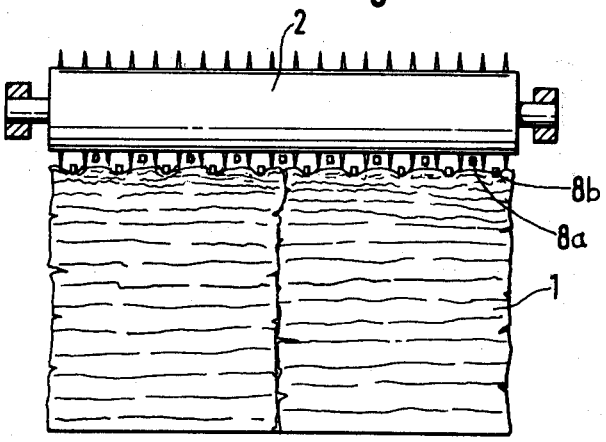

Turning now to FIGS. 2*a*, 2*b*, 3*a* and 3*b*, in the embodiment illustrated therein, there is provided a grate assembly which is formed of a first group of grate bars 8*a* and a second group of grate bars 8*b*. The grate bars of both groups are rotatably held at their ends in a support 9. As seen in FIGS. 2*a* and 3*a*, for a pass in the direction of arrow A, the grate bars 8*a* lie directly on the upper surface of the fiber bales, while the grate bars 8*b* are in a vertically upwardly pivoted inoperative position (that is, the grate bars 8*b* are lifted off the fiber bales 1). FIGS. 2*b* and 3*b* show the position of the grate assembly during a successive pass in the direction of the arrow B. As seen, in this phase of the operation the grate bars 8*b* engage the upper face of the fiber bales 1 whereas the grate bars 8*a* have been pivoted into their inoperative position upwardly off the surface of the fiber bales. In this manner the opening elements 5 can laterally tear out fiber from the exposed, non-pressed ridges.

Figure 4A:
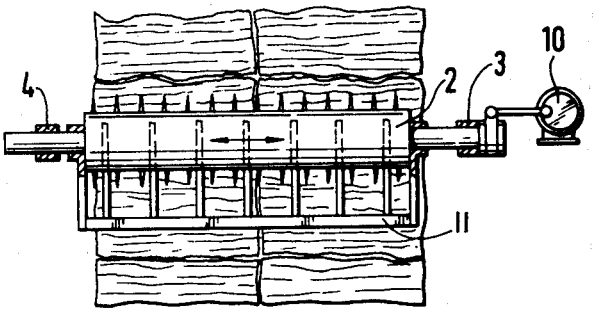
FIGS. 4*a* and 4*b* are schematic front elevational views of still another embodiment of the invention, shown in different operational phases.
Figure 4B:
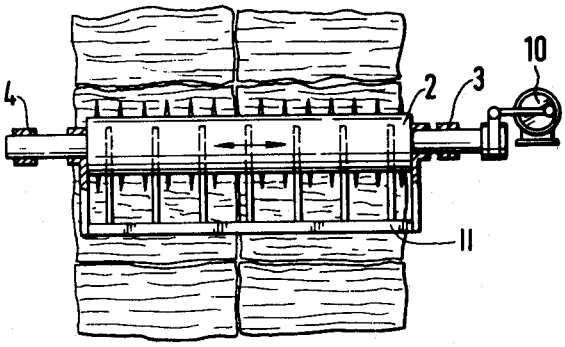

Turning now to FIGS. 4*a* and 4*b*, there is shown a further embodiment of the invention in which, similarly to the embodiment shown in FIGS. 1*a* and 1*b*, the opening roller and the grate are shifted laterally and horizontally in unison. In order to provide that during the pass, that is, during the opening operation itself, the opening roller 2 as well as the grate 11 can be shifted, the stub shaft of the roller 2 is coupled with a crank drive 10.

It is to be understood that instead of a spiked roller the opening device may be formed of a series of toothed opening discs mounted on a common shaft.

Further, it is within the scope of the invention to provide for a lateral shift of the bales, rather than displacing the grates as disclosed in the illustrated embodiments.

It will be understood that the above description of the present invention is susceptible to various modifications, changes and adaptations and the same are intended to be comprehended within the meaning and range of equivalents of the appended claims.

What is claimed is:

1. In a method of opening fiber bales with an apparatus having a traveling opening member propelled along serially positioned fiber bales to execute opening passes, a grate having parallel-spaced grate bars extending, in their operative position, in the traveling direction and pressing down on an upper surface of the bales; the opening member having opening elements projecting through the clearance defined by adjoining grate bars; the improvement comprising the step of periodically and in opposing phases lifting and lowering several grate bar groups of the grate between operative and inoperative positions for periodically varying the relative position between the upper surface of the bales and the grate to periodically expose ridges of bale material formed underneath the grate bars during the opening operation.

2. A method as defined in claim 1, wherein the lifting and lowering is effected at the lifting completion of a pass.

3. A method as defined in claim 1, wherein the shifting step is effected during passes.

4. In an apparatus for opening fiber bales including an opening member arranged for travel along serially arranged fiber bales to execute opening passes; a grate including parallel-spaced grate bars having an operative position in which they extend parallel to the direction of travel of the opening member and press down on an upper surface of the bales; the opening member having opening elements projecting through clearances defined between adjoining grate bars; the improvement wherein said grate comprises first and second groups of grate bars and the grate bars belonging to different groups are arranged alternatingly as viewed in a direction transverse to the traveling direction of said opening member; the improvement further comprising support means for supporting the grate bars for movement in a vertical plane; the grate bars of said first group being movable with respect to the grate bars of said second group for laterally varying the operative position of the grate bars, whereby ridges of bale material formed underneath the grate bars are periodically exposed.

* * * * *